United States Patent [19]

Mitter

[11] 3,988,985

[45] Nov. 2, 1976

[54] SQUEEGEE DRIVE FOR ENDLESS SCREEN PRINTING MACHINE

[75] Inventor: Mathias Mitter, Verl-Sende-Mitte, Germany

[73] Assignee: Mitter & Co., Schloss Holte, Germany

[22] Filed: June 19, 1974

[21] Appl. No.: 479,911

[30] Foreign Application Priority Data

June 20, 1973 Germany ..... 2331358

[52] U.S. Cl. ..... 101/119; 101/122

[51] Int. Cl.[2] ..... B41F 15/42; B41F 15/46

[58] Field of Search ..... 101/115, 116, 119, 120, 101/122, 121, 248

[56] References Cited

UNITED STATES PATENTS

| | | | |
|---|---|---|---|
| 2,560,774 | 7/1951 | Luttenauer | 101/248 |
| 2,650,537 | 9/1953 | Rosse | 101/157 |
| 2,698,574 | 1/1955 | Dougherty et al. | 101/120 |
| 3,487,775 | 10/1970 | Chaney et al. | 101/122 X |
| 3,625,145 | 12/1971 | Heatley et al. | 101/212 X |
| 3,807,302 | 4/1974 | Kudlich | 101/119 |
| 3,811,378 | 5/1974 | Bohm | 101/119 X |
| 3,859,916 | 1/1975 | Zimmer | 101/119 |

*Primary Examiner*—Edgar S. Burr
*Assistant Examiner*—R. E. Suter
*Attorney, Agent, or Firm*—Michael J. Striker

[57] ABSTRACT

A silk screen printing machine wherein a hollow endless stencil surrounds a liquid applying roll and the latter is driven independently of the stencil by a detachable infinitely variable speed drive having a gear which is keyed to an extension at one end of the shaft for the liquid applying roll. The drive is mounted on a carriage so that it can be transported between several screen printing stations.

25 Claims, 8 Drawing Figures

TR
F
II
IV
1
2
3
4
6
7
12
13
14
15
107
30
31
41
S 50
62
S
7
141
42
65
61
242
41
60
442
6'
60A
60B
76
71
60b
60a
72
70
75
73
74

SQUEEGEE DRIVE FOR ENDLESS SCREEN PRINTING MACHINE

BACKGROUND OF THE INVENTION

The present invention relates to screen printing machines in general, and more particularly to improvements in means for rotating the liquid applying roll or squeegee which cooperates with a moving endless stencil or screen to apply coloring matter or another liquid to selected portions of a moving fabric or the like.

In many presently known screen printing machines, the stencil is a liquid-permeable hollow cylinder or endless band which surrounds a rotary liquid applying roll. The latter can rotate in response to frictional engagement with the stencil or it may be coupled to a power train which receives motion from the means for moving the stencil. Thus, the speed of the roll is always a function of the speed of the stencil, i.e., the peripheral speed of the roll increases in response to increasing speed of the stencil or vice versa.

SUMMARY OF THE INVENTION

An object of the invention is to provide a screen printing machine with novel and improved means for rotating the liquid applying roll in such a way that the speed of the roll need not necessarily change in response to changes in speed of movement of the stencil or vice versa.

Another object of the invention is to provide a screen printing machine with a novel and improved drive which can be used to rotate one or more liquid applying rolls and which can rotate a selected liquid applying roll at any one of a large number of speeds to thus enable the machine to produce special effects and/or to conform the rate of application of liquid to the nature of material to be printed and/or to certain other parameters.

A further object of the invention is to provide a screen printing machine wherein the speed of the liquid applying roll or rolls need not depend on the speed of the stencil, on the speed of material to be printed and/or on the speed of the customary back cloth for the material to be printed.

An additional object of the invention is to provide novel torque transmitting means between a selected liquid applying roll and the improved drive.

Still another object of the invention is to provide a drive which can be rapidly attached to or detached from a selected liquid applying roll and which comprises a relatively small number of simple, rugged and compact parts.

A further object of the invention is to provide means for facilitating the transport of the improved drive between two or more discrete liquid applying rolls.

The invention is embodied in a screen printing machine having an endless cylindrical or belt-like stencil and a liquid applying roll in the interior of the stencil. In accordance with a feature of the invention, the means for rotating the roll is independent of the means for moving the stencil, and such rotating means preferably comprises an infinitely variable speed drive having a rotary output member which rotates the shaft of the liquid applying roll through the medium of a torque transmitting device preferably including a sleeve which is coupled to the shaft and a stub which is driven by the output member and is separably coupled to the shaft by a screw or the like. The drive can be separated from the extension and is preferably mounted on a carriage so that it can be transported between several printing stations.

The novel features which are considered as characteristic of the invention are set forth in particular in the appended claims. The improved screen printing machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
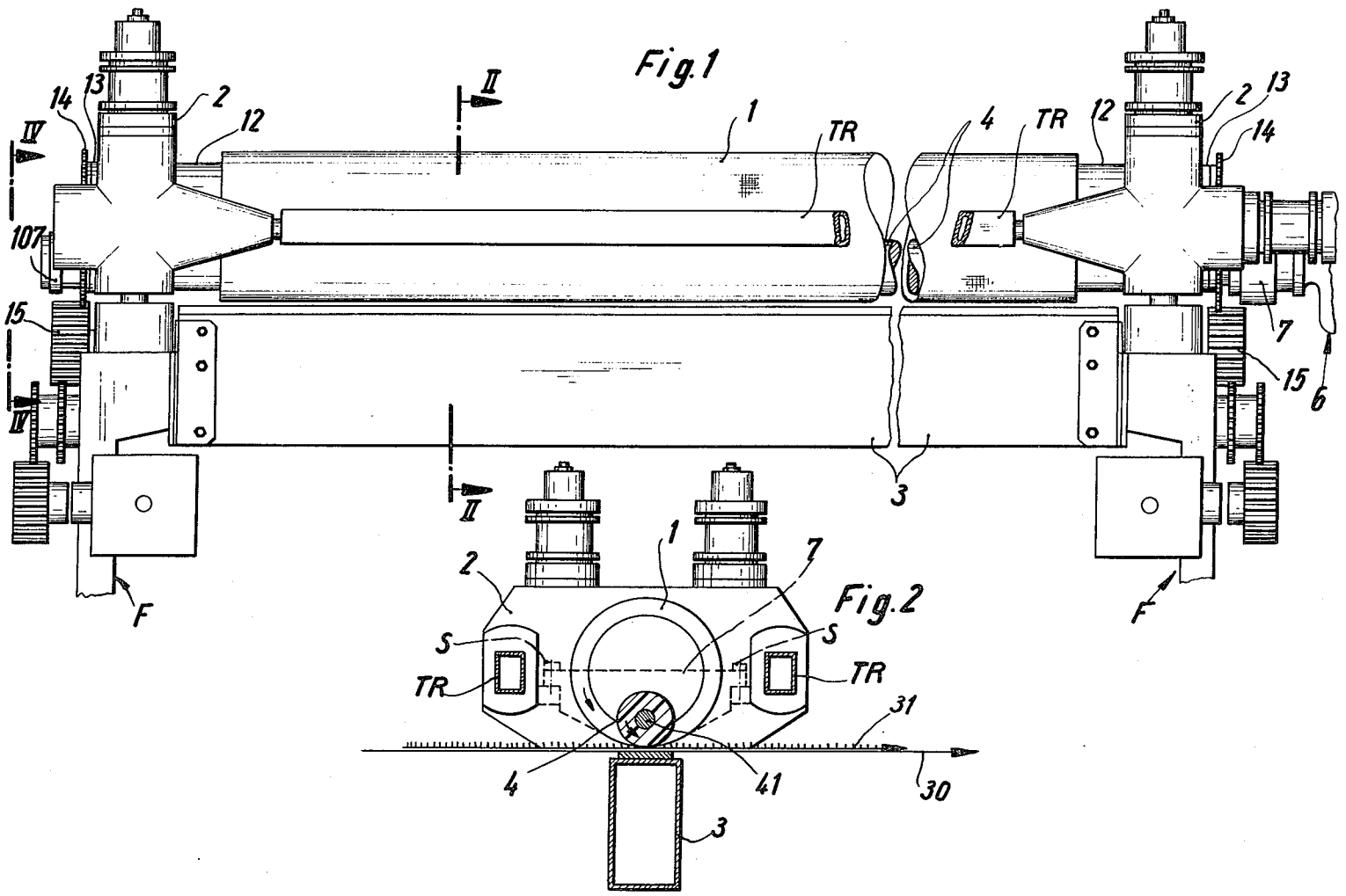
FIG. 1 is a fragmentary schematic elevational view of a screen printing machine which embodies the invention.
FIG. 2 is a sectional view as seen in the direction of arrows from the line II—II of FIG. 1.
Figure 3:
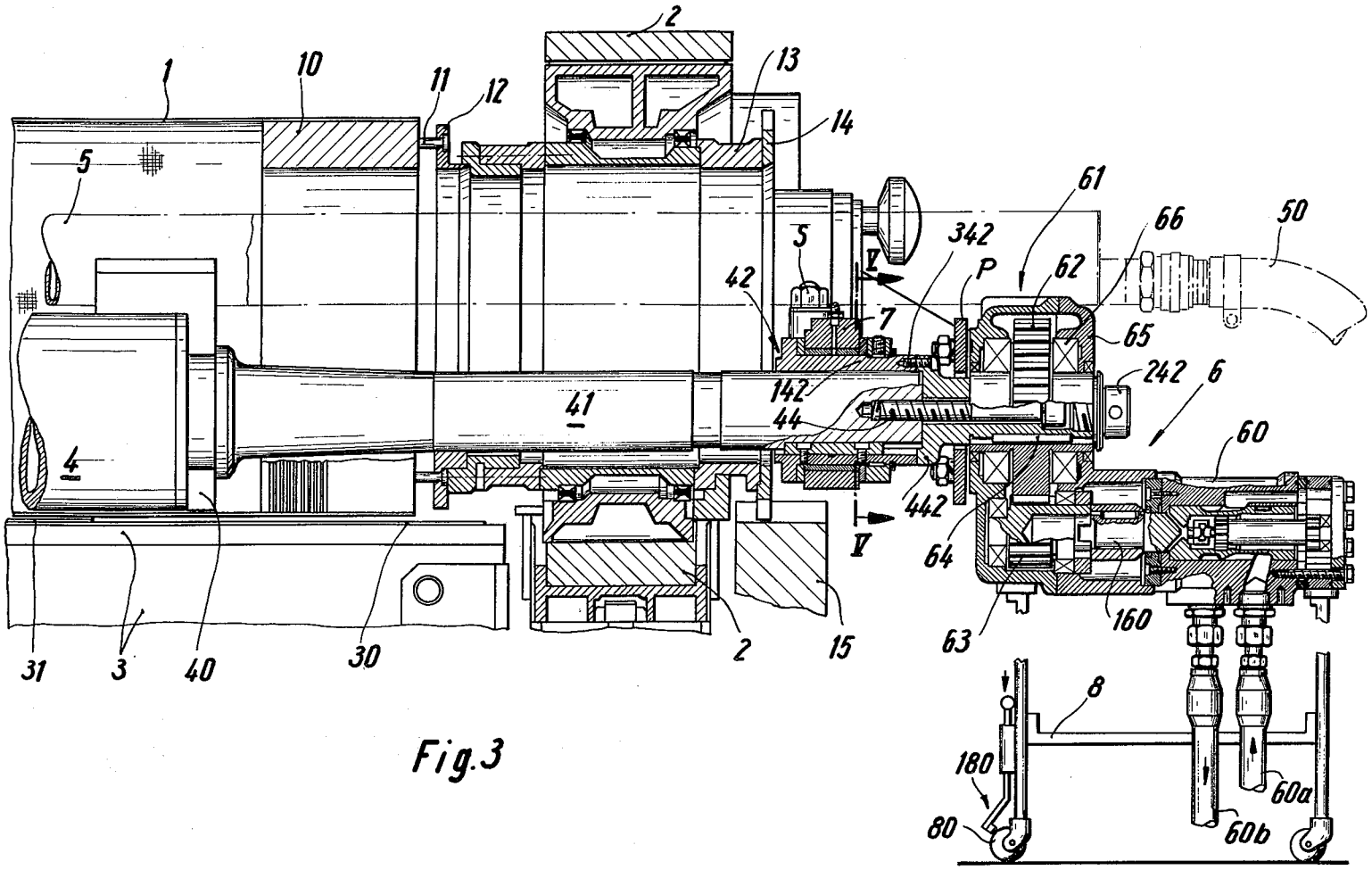
FIG. 3 is an enlarged partly sectional view of the structure shown in the right-hand portion of FIG. 1, further showing in section the entire drive for the liquid applying roll and a carriage for the drive.

Referring first to FIGS. 1 to 3, there is shown a portion of a screen printing machine having a frame or housing F which includes or carries two bearing members or heads 2 for an endless screen or stencil 1 here shown as a hollow cylinder whose axial ends are secured to annular holders 10. However, it is equally within the purview of the invention to employ a stencil in the form of an endless band which is trained around at least three rollers at least one of which constitutes a tensioning means. The annular holders 10 are separably attached to supporting rings 12 by means of axially movable spring-biased pins 11, and the rings 12 are rotatably mounted in the respective bearing members 2. The outer end portion 13 of each supporting ring 12 is provided or connected with a gear 14 forming part of a means for moving the stencil 1 about the common axis of the holders 10. The moving means further comprises gears 15 which mate with the gears 14. Additional gears of the means for moving the stencil 1 are shown in the left-hand and right-hand portions of FIG. 1; it is clear, however, that the stencil 1 can be driven at one end only, i.e., the one or the other of the two gear trains (including the gears 14, 15) can be dispensed with.

The frame F further supports a pressure beam or back support 3 which is located directly below the stencil 1 and defines therewith a narrow clearance for a web 31 of material to be printed (e.g., a fabric) and a back cloth 30. The manner in which the fabric 31 and back cloth 30 are transported in directions indicated by arrows (FIG. 2) is known.

A liquid applying roll or squeegee 4 is installed in the interior of the stencil 1 opposite the beam 3. The ends of the roll 4 are adjacent to fixedly mounted barriers or seals 40 which prevent the liquid from spreading axially of the screen 1, i.e., outwardly and beyond the ends of the roll 4. A liquid supply tube 5 extends into the stencil 1 above the roll 4 to deliver thereto an ink, paint or dye when the machine is in use. The right-hand end portion of the tube 5 (as viewed in FIG. 3) is connected with a source of liquid by a conduit 50, e.g., a flexible hose. When the roll 4 is rotated, it causes the liquid to penetrate through selected portions of the stencil 1 to thereby produce on the fabric 31 a design of predetermined configuration. The liquiud can pass through the stencil 1 in the region between the two stationary barriers or seals 40. The quantity of liquid which is forced through the stencil 1 can be changed by varying the speed of the roll 4 with respect to the speed of the stencil 1. In accordance with a feature of the invention, the shaft 41 of the roll 4 can be rotated independently of the means (including the gears 14, 15) for moving the stencil 1 and independently of the means which moves the fabric 31 and/or back cloth 30. The means for rotating the roll 4 comprises an infinitely variable speed drive 6 which is shown in detail in the right-hand portion of FIG. 3 and comprises a prime mover including a fluid-operated (preferably hydraulic) motor 60 and a step-down transmission 61 having a rotary output member 62 (here shown as a gear) which rotates the shaft 41 through the medium of a torque transmitting device or extension 42. The input member of the transmission 61 is a pinion 63 which meshes with the gear 62 and is driven by the output shaft 160 of the motor 60. The gear 62 can be slipped onto or off an outer portion or stub 442 of the extension 42 and rotates the latter through the medium of a key 64. The case 65 of the transmission 61 contains one or more antifriction bearings 66 for the stub 442. This stub is integral with a sleeve-like portion 142 (hereinafter called sleeve) which surrounds the right-hand end portion of the shaft 41. As shown in FIG. 3, the sleeve 142 extends through a bearing member 7 and rotates therein in suitable friction bearings. The bearing member 7 is secured to the adjacent head 2 by bolts, screws or analogous fasteners S.

The means for separably coupling the extension 42 to the adjacent end portion of the shaft 41 for the roll 4 comprises a screw 44 which extends through an axial bore of the stub 442 and into a tapped bore in the shaft 41. The head of the coupling screw 44 is adjacent to that end of the stub 442 which is remote from the right-hand end of the shaft 41 and sleeve 142. A cap 242 is affixed to and overlies the head of the coupling screw 44; a flange of this cap can hold the case 65 of the transmission 61 against axial movement on the extension 42. The latter rotates with the shaft 41. The screw 44 may be used as a means for effecting certain axial adjustments of the roll 4 with respect to the stencil 1. When properly mounted on the stub 442, the case 65 of the transmission 61 abuts against a plate-like member P of the frame F.

Figure 4:
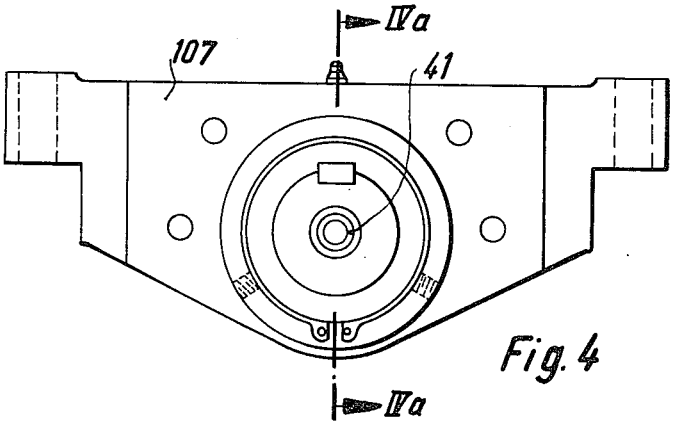
FIG. 4 is an enlarged end elevational view of the left-hand bearing for the shaft of the liquid applying roll, substantially as seen in the direction of arrows from the line IV—IV of FIG. 1.

The left-hand end portion of the shaft 41 for the roll 4 is mounted in a second bearing 107 (shown in FIGS. 4 and 5) which is affixed (e.g., bolted) to the adjacent head 2. The machine comprises tie rods TR which connect the heads 2 to each other to thus stabilize the bearing means for the stencil 1. As shown in FIG. 2, the frame F may comprise a first tie rod TR in front and a second tie rod TR behind the stencil 1.

The manner in which the speed of the motor 60 can be varied so that the gear 62 can drive the roll 4 at an infinite number of speed is well known in the art. For example, the motor 60 may constitute a balanced or unbalanced vane motor. The conduits which respectively admit pressurized hydraulic fluid (e.g., oil) to and evacuate spent fluid from the motor 60 are shown at 60*a* and 60*b*. It has been found that, by using a suitable step-down transmission 61, the machine will operate satisfactorily if the output member 160 of the motor 60 rotates at or close to 300 RPM. The speed of the motor 60 can be regulated by changing the rate of fluid admission via conduit 60*a;* this renders it possible to drive the shaft 41 of the roll 4 at an infinite number of speeds; however, it is equally within the purview of the invention to provide for the roll 4 an independent drive which can rotate the shaft 41 at a preferably large but nevertheless finite number of different speeds.

Figure 6:
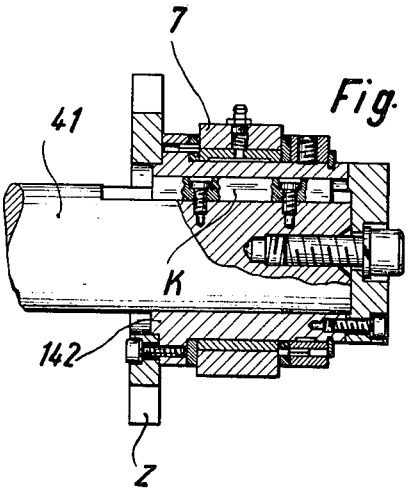
FIG. 6 is a sectional view as seen in the direction of arrows from the line VI—VI of FIG. 5.
Figure 4A:
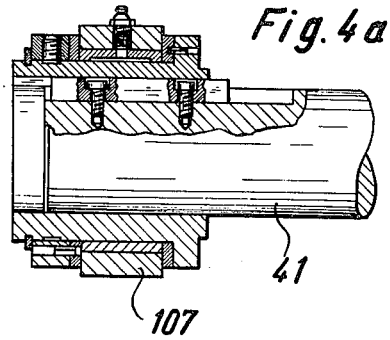
FIG. 4*a* is a sectional view as seen in the direction of arrows from the line IV*a*—IV*a* of FIG. 4.
Figure 5:
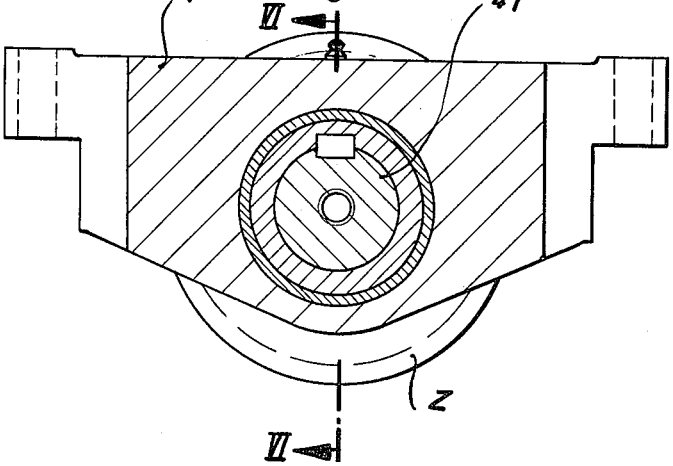
FIG. 5 is a transverse vertical sectional view of the right-hand bearing for the liquid applying roll, substantially as seen in the direction of arrows from the line V—V of FIG. 3.

In order to enhance the utility and versatility of the improved drive 6 for the shaft 41, the drive is preferably mounted on a suitable carriage 8 here shown as a dolly having a frame with ground-contacting wheels 80. A suitable braking device 180 can be provided for at least one of the wheels 80 to immobilize the carriage 8 and the drive 6 at the selected locale of use. The carriage 8 enables an attendant to move the drive 6 to or from selected liquid applying rolls in a single screen printing machine or to or from the rolls 4 of different screen printing machines. The case 65 can be separated from the shaft 41 by the simple expedient of removing the cap 242 and shifting the carriage 8 so as to move the transmission 61 away from the frame member P. The transmission of torque from the gear 62 to the extension 42 is terminated in response to removal of the key 64 which is accessible upon detachment of the cap 242. The drive 6 can be separated from the roll 4 while the coupling screw 44 remains attached to the shaft 41 except, of course, if the stub 442 is to be separated with the case 65. In such instances, the stub 442 is separably connectable to the sleeve 142 (which can remain in the bearing 7) by one or more screws 342 or the like. The establishment of a torque transmitting connection between the gear 62 and shaft 41 can be completed within an extremely short interval of time so that the drive 6 can be rapidly transported between and coupled to the rolls 4 of selected printing machines. If the drive 6 is to be used in connection with a single roll 4, it can be mounted in the frame F for movement axially of the shaft 41, i.e., between an operative position (shown in FIG. 3) and an inoperative position in which the gear 62 cannot rotate the sleeve 142 and shaft 41. In such inoperative position of the drive 6,, the shaft 41 can be rotated by the means for moving the stencil 1 so that the rotational speed of roll 4 is synchronized with the speed of the stencil 1 in a manner known from conventional screen printing machines. FIGS. 5 and 6 show a gear Z which can be threadedly connected to the shaft 41 and/or extension 42 when the latter is not rotated by the drive 6. The gear Z can receive torque from the main prime mover of the screen printing machine so that the roll 4 is then rotated in synchronism with the stencil 1. The gear Z can be removed or disconnected from the main prime mover when the extension 42 is rotated by the drive 6.

FIG. 6 further shows a key K which transmits torque from the sleeve 142 to the shaft 41.

At the present time, it is preferred to mount the drive 6 on a carriage or the like so that it can be readily and rapidly transported between several rolls 4. Also, it is presently preferred to employ two-piece motion transmitting means including a sleeve 142 which remains attached to the shaft 41 of a liquid applying roll 4 and is rotatable in the corresponding fixed bearing 7, and a stub 442 which is separably secured to the sleeve 142 9as by aforementioned screws 342) so that it can remain coupled to and is movable with the case 65 of the transmission 61.

The utilization of improved drive 6 in presently known screen printing machines necessitates only minor alterations in the design of such machines. Thus, an important or desirable requirement is that one end portion of the shaft 41 extend outwardly beyond the stencil 1, the corresponding annular holder 10 and bearing member or head 2 so that such end portion is accessible for attachment of the entire torque transmitting means 42, a portion 442 of the torque transmitting means, or for attachment of the output member 62 to a torque transmitting means on the shaft 41. The importance of that barrier or seal 40 which is nearer to the torque transmitting means 42 will be readily appreciated by considering that the shaft 41 must extend through and beyond the parts 10, 12 and 2.

Figure 7:
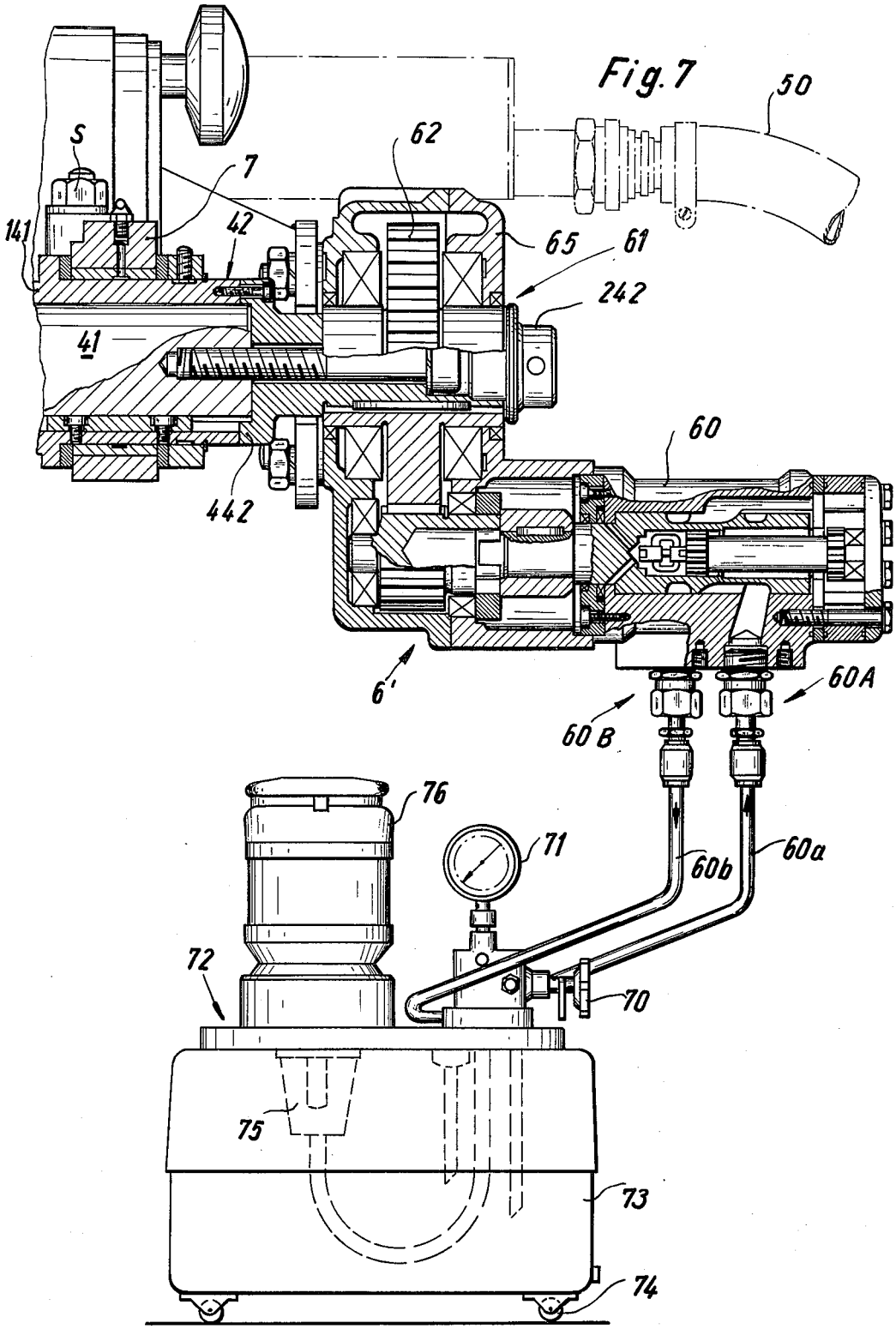
FIG. 7 illustrates a modification of the structure shown in the right-hand portion of FIG. 3.

FIG. 7 shows a portion of a screen printing machine which is preferably identical with or similar to the machine of FIGS. 1 to 3, and a slightly modified drive 6' for the shaft 41 of the liquid applying roll. The transmission 61 and motor 60 are identical with the similarly referenced components shown in FIG. 3. The conduits 60*a*, 60*b* are separably connected to corresponding ports of the motor housing by suitable connecting devices 60A, 60B and the pressure of fluid in the conduit 60*a* can be regulated by a relief valve 70. Such pressure can be monitored by a suitable gauge 71. The parts 70, 71 are mounted on a housing 72 which contains a reservoir or tank 73 and is mounted on wheels 74. A pump 75 which draws fluid from the tank 73 and forces pressurized fluid into the conduit 60*a* is driven by an electric motor 76 which is mounted on top of the housing 72. The conduit 60*b* discharges spent fluid into the tank 73.

It is further within the purview of the invention to employ a drive which comprises a constant-speed motor (e.g., an electric motor) and a varaible speed transmission which is driven by the constant-speed motor and can rotate the shaft 41 of the liquid applying roll 4 at a finite or infinite number of speeds independently of the means for moving the stencil, the fabric and/or the back cloth. All that counts is to provide a drive which can rotate the shaft 41 of the roll 4 at a preferably large number of different speeds and which is preferably detachable or separable from the shaft 41 so that it can be used to rotate one or more additional rolls 4 and/or that the roll 4 which has been disconnected from the drive can be rotated in a conventional manner, e.g., in response to frictional engagement with the cylindrical stencil 1 or a band-like stencil or by the prime-mover through the medium of the gear Z. When the improved drive is properly coupled to the shaft 41 of a roll 4, the speed of the roll can be changed while the screen printing machine is in use or while the stencil is idle. The speed of the roll 4 will be changed in dependency on the nature of material to be printed, on the desired effect, on the nature of liquid (which may but need not be a coloring matter) and/or on the speed of other moving parts including the stencil, fabric and/or back cloth. It is also within the purview of the invention to provide a detachable drive for each roll of a machine or for the roll or rolls of each machine in a screen printing establishment. As a rule, it suffices to provide one drive for several liquid applying rolls. When the drive is detached from a first roll to be attached to a selected second roll or to remain idle, the first roll can be rotated due to frictional engagement with the respective stencil or by the gear Z.

Without further analysis, the foregoing will so fully reveal the gist of the present invention that others can by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In a screen printing machine, the combination of an endless stencil; first means for moving said stencil; a liquid applying roll located within said stencil and having a shaft projecting outwardly therefrom; second means comprising a drive unit mounted on and engaging said shaft outside said stencil for rotating said roll, said second means being entirely separate from and independent of said first means so as to rotate said roll indepedently of the movements of said stencil, said drive unit comprising an infinitely variable speed drive, and further comprising torque transmitting means separably coupling said drive unit with said roll; and means for moving said drive unit into and out of coupled engagement with said roll, so that said drive unit may be uncoupled from said shaft and moved to other locations.

2. The combination of claim 1, wherein said drive unit for rotating said roll comprises a variable speed drive for rotating said roll at any one of a plurality of speed independently of said moving means.

3. The combination of claim 1, further comprising an annular holder for one end of said stencil and a hollow bearing member for said holder, said shaft extending through and having an end portion projecting beyond said holder and said bearing member, and torque transmitting means comprising a sleeve affixed to said portion of said shaft.

4. The combination of claim 3, further comprising a frame and a bearing fixed to said frame and rotatably receiving said sleeve.

5. The combination of claim 3, further comprising a barrier provided in said stencil inwardly of said holder to prevent the liquid from spreading toward said holder and said bearing member.

6. The combination of claim 1, wherein said drive unit comprises an infinitely variable speed drive, and torque transmitting means coupling said drive unit with said roll.

7. The combination of claim 6, wherein said torque transmitting means comprises an extension having a sleeve surrounding said one end portion of and mounted on said shaft, and a stub coaxial with said sleeve and receiving torque from said drive unit, and means for coupling said stub and said sleeve to said shaft.

8. The combination of claim 6, further comprising a mobile carriage for said drive unit.

9. The combination of claim 6, wherein said drive unit comprises a rotary output member, said torque transmitting means being secured to said one end portion and being and being separably connected with said output member.

10. The combination of claim 9, wherein said output member at least partly surrounds said torque transmitting means.

11. The combination of claim 6, wherein said torque transmitting means comprises an extension mounted on and surrounding said one end portion of said shaft, said drive unit having a rotary output member surrounding said extension.

12. The combination of claim 11, further comprising a frame and a bearing secured to said frame, said extension having a portion which is rotatable in said bearing.

13. The combination of claim 6, wherein said torque transmitting means includes an extension secured to said one end portion of said shaft, said drive unit having a toothed rotary output member drivingly connected with said extension.

14. The combination of claim 13, wherein said output member surrounds a portion of said extension and further comprising a key interposed between said gear and said extension to drive the latter in response to rotation of said output member.

15. The combination of claim 6, wherein said torque transmitting means is secured to said shaft outside of said stencil.

16. The combination of claim 12, wherein said shaft extends through and beyond said bearing.

17. The combination of claim 6, wherein said drive unit comprises a prime mover and a transmission, said transmission having a rotary input member driven by said prime mover and a rotary output member driving said torque transmitting means.

18. The combination of claim 17, wherein said prime mover comprises an infinitely variable speed motor.

19. The combination of claim 18, wherein said motor is a fluid-operated motor.

20. The combination of claim 6, wherein said drive unit comprises a prime mover including an electric motor and a transmission drive by said motor and rotating said roll.

21. The combination of claim 20, wherein said motor is a variable speed motor.

22. The combination of claim 21, wherein said transmission is a variable speed transmission.

23. In a screen printing machine, the combination of an endless stencil; first means for moving said stencil; a liquid applying roll located within said stencil and having a shaft projecting outwardly therefrom; and second means comprising a drive unit mounted on and engaging said shaft outside said stencil for rotating said roll, said second means being entirely separate from and independent of said first means so as to rotate said roll independently of the movements of said stencil and said drive unit comprising an infinitely variable speed drive, and torque transmitting means coupling said drive unit with said roll; said torque transmitting means having an extension provided with a sleeve surrounding one end portion of and mounted on said shaft, and a stub coaxial with said sleeve and receiving torque from said drive unit, and means for coupling said stub and said sleeve to said shaft, including a screw extending axially through said stub and into a tapped bore of said shaft.

24. The combination of claim 23, wherein said stub has an end remote from said sleeve and said screw has a head in the region of said remote end, and further comprising a cap secured to said stub and overlying said head.

25. In a screen printing machine, the combination of an endless stencil; first means for moving said stencil; a liquid applying roll located within said stencil and having a shaft projecting outwardly therefrom; second means comprising a drive unit mounted on and engaging said shaft outside said stencil for rotating said roll, said second means being entirely separate from and independent of said first means so as to rotate said roll independently of the movements of said stencil, said drive unit comprising an infinitely variable speed drive, and further comprising torque transmitting means separably coupling said drive unit with said roll; and a mobile carriage for said drive unit, including a frame supporting said drive unit, ground-contacting wheels mounted on said frame, and means for braking at least one of said wheels, so that said drive unit may be uncoupled from said shaft and moved to other locations where the carriage can be arrested against undesired movement by said braking means.

* * * * *